US007541751B2

(12) United States Patent
Vaziri

(10) Patent No.: US 7,541,751 B2
(45) Date of Patent: Jun. 2, 2009

(54) SOFT START CONTROL CIRCUIT FOR LIGHTING

(75) Inventor: Ali Vaziri, Churchville, PA (US)

(73) Assignee: MDL Corporation, Langhorne, PA (US)

( * ) Notice: Subject to any disclaimer, the term of this patent is extended or adjusted under 35 U.S.C. 154(b) by 0 days.

(21) Appl. No.: 11/682,124

(22) Filed: Mar. 5, 2007

(65) Prior Publication Data

US 2008/0218101 A1 Sep. 11, 2008

(51) Int. Cl.
*H05B 37/02* (2006.01)

(52) U.S. Cl. ..... 315/307; 315/274; 315/297; 315/360

(58) Field of Classification Search ..... 315/291, 315/294, 297, 307, 314, 209 R, 274, 360; 323/237–238, 242, 247, 300, 301, 321, 323, 323/326

See application file for complete search history.

(56) References Cited

U.S. PATENT DOCUMENTS

| | | | |
|---|---|---|---|
| 3,323,013 | A | 5/1967 | Lord |
| 3,397,355 | A | 8/1968 | Frank |
| 3,728,611 | A | 4/1973 | Elvin |
| 3,936,696 | A | 2/1976 | Gray |
| 4,163,925 | A | 8/1979 | Gyursanszky |
| 4,345,188 | A | 8/1982 | Gries et al. |
| 4,350,933 | A | 9/1982 | Agarwala et al. |
| 4,358,713 | A | 11/1982 | Senoo et al. |
| 4,367,434 | A | 1/1983 | Miller |
| 4,408,154 | A | 10/1983 | Cote |
| 4,443,740 | A | 4/1984 | Goralnik |
| 4,540,917 | A | 9/1985 | Luchaco et al. |
| 4,663,570 | A | 5/1987 | Luchaco et al. |
| 4,714,870 | A | 12/1987 | Nilsson |
| 4,803,586 | A | 2/1989 | Tabor et al. |
| 4,894,587 | A | 1/1990 | Jungreis et al. |
| 5,105,127 | A | 4/1992 | Lavaud et al. |
| 5,121,032 | A | 6/1992 | Han |

(Continued)

FOREIGN PATENT DOCUMENTS

| | | |
|---|---|---|
| GB | 409128 | 4/1934 |

(Continued)

OTHER PUBLICATIONS

1997 Q-Tran, Inc.—"Multi Volt Voltage Drop Calculator", Q-Tran, inc. MV Voltage Drop Calculator Instruction Manual, copyright 1997, 8 pgs., Q-Tran, Inc., 114-B Washington Street, South Norwalk, Connecticut 06854.

(Continued)

*Primary Examiner*—David Hung Vu
*Assistant Examiner*—Tung X Le
(74) *Attorney, Agent, or Firm*—Panitch Schwarze Belisario & Nadel LLP

(57) ABSTRACT

A low voltage lighting system includes a transformer having at least a primary winding and a secondary winding. The low voltage lighting system also includes one or more lighting elements and a voltage control circuit. The lighting elements are coupled to the secondary winding. The voltage control circuit is electrically coupled with the primary winding. The voltage control circuit is configured to automatically increase the voltage applied to the primary winding of the transformer in a predetermined manner from a first voltage to a second voltage over a predetermined period of time.

11 Claims, 4 Drawing Sheets

U.S. PATENT DOCUMENTS

| | | | | |
|---|---|---|---|---|
| 5,289,110 | A | 2/1994 | Slevinsky | |
| 5,477,113 | A | 12/1995 | Christoffersson | |
| 5,495,149 | A * | 2/1996 | Hiramatsu et al. | 315/209 R |
| 5,510,948 | A | 4/1996 | Tremaine et al. | |
| 5,534,755 | A * | 7/1996 | Deavenport et al. | 315/307 |
| 5,569,983 | A * | 10/1996 | McGuire et al. | 315/297 |
| 5,602,462 | A | 2/1997 | Stich et al. | |
| 5,623,397 | A * | 4/1997 | Vinciarelli | 363/20 |
| 5,789,828 | A | 8/1998 | Tremaine et al. | |
| 6,137,277 | A | 10/2000 | Rajda et al. | |
| 6,188,182 | B1 * | 2/2001 | Nickols et al. | 315/294 |
| 6,639,366 | B2 * | 10/2003 | Bai | 315/219 |
| 7,049,765 | B1 | 5/2006 | Tremaine et al. | |
| 7,161,309 | B2 * | 1/2007 | Chiou et al. | 315/291 |
| 2002/0175636 | A1 * | 11/2002 | Kawasaka et al. | 315/224 |
| 2003/0076054 | A1 * | 4/2003 | Bai | 315/224 |
| 2003/0090218 | A1 * | 5/2003 | Iannini | 315/276 |
| 2006/0125414 | A1 * | 6/2006 | Oda et al. | 315/276 |
| 2006/0171179 | A1 * | 8/2006 | Hall et al. | 363/95 |
| 2007/0040516 | A1 * | 2/2007 | Chen | 315/291 |
| 2007/0069658 | A1 * | 3/2007 | Green et al. | 315/209 R |
| 2007/0285028 | A1 * | 12/2007 | Tsinker et al. | 315/224 |
| 2008/0018262 | A1 * | 1/2008 | Green | 315/225 |

FOREIGN PATENT DOCUMENTS

| | | |
|---|---|---|
| GB | 842412 | 7/1960 |

OTHER PUBLICATIONS

2000 Q-Tran, Inc, . . . "Voltage Drop Calculator for Rough In Wiring", Q-Tran, inc. Voltage Drop Calculator For Rough IN Wiring Instruction Manual, copyright 2000, 2 pgs., Q-Tran, Inc., 304 Bishop Avenue, Bridgeport. CT 06610.

2000 Q-Tran, Inc.—"Single Transformer QX Low Voltage Fixture Power Supply Center™", Power Supply Center™, Ordering Information and Specifications Insert, copyright 2000, 2 pgs. , Q-Tran, Inc., 304 Bishop Avenue, Bridgeport. CI 06610.

Q-Tran, Inc. . . . QX Installation Instructions for Power Supply Center™ (PSC), Instruction Sheet for QX Installation Instruction For Power Supply Center™ (PSC) (date unknown), Q-Tran, Inc., 304 Bishop Avenue, Bridgemport, CT 06610.

Q-Tran, Inc.—"QX Singles—Ordering Guide", q-Tran, Inc. Order Form for AX Singles, 4 pgs.. (date unknown); Q-Tran, Inc., 304 Bishop Avenue, Bridgeport, CT 06610.

Q-Tran, Inc.—"Why A Power Supply Center™", Q-Tran, Inc. Advertisement Pamphlet, 4 pgs.. 2000, Q-Tran, Inc., 304 Bishop Avenue, Bridgeport, CT 06610.

Q-Tran, Inc—"Power Supply Center™ Low Voltage Lighting", Q-Tran, Inc. power Supply Center™ Ordering Information and Specifications. Installation Instructions and Layout Guide/Advertisement Booklet, copyright 1998. 6 pgs., Q-Tran, Inc., 304 Bishop Avenue, Bridgeport, CT 06610.

1995 Q-Tran, Inc.—"Enlightened Thinking™ Low Volatage Lighting Power Supply Center", Q-Tran, Inc. Advertising Booklet, 1995, 16 pgs., Q-Tran, Inc., 114-B Washington Street, Norwalk CT 06854.

Ernst. "Illumination control Circuit", IBM Technical Disclosure Bulletin, May, 1978, 1pg., Boulder, Colorado.

Butler Winding Web Page, "Electronic Transformers", Butler Winding web page publication, 2 pgs., (date unknown), Butler Winding, 201 Pillow Street, Butler. PA 16001.

* cited by examiner

SOFT START CONTROL CIRCUIT FOR LIGHTING

BACKGROUND OF THE INVENTION

Embodiments of the present invention relate generally to low voltage lighting systems, and more particularly, to a low voltage lighting system having a soft-start.

Low Voltage lighting systems typically include a switch, a transformer or other voltage reduction device and one or more lighting elements or lamps. The switch may be a timer, a photocell, a single on-off light switch, or another suitable switching device. The transformer provides voltage reduction of incoming alternating current (AC) voltage.

In an incandescent lamp, an electric current passes through a thin filament, heating the filament and causing it to emit light. When the lamp is off the filament resistance is one tenth of the hot resistance. The power delivered to the lamp during startup (i.e., when the switch is first closed and a voltage is applied across the filament) is extremely high, causing a lamp surge current. A magnetizing current on the transformer on startup can also be very high, which causes a transformer surge current. The two surge currents may cause some circuit breakers to false trip at startup. Additionally, the current surge during startup causes a thermal shock to the lighting elements. In the winter, when the lamp is initially colder while it is off, the rapid change in temperature on startup is greater and lamp failure occurs much more frequently. With a conventional incandescent lamp, surge protectors are sometimes used in order to mitigate the effects of surge currents. However, the surge protectors use additional power, causing surge protector losses.

It is desirable to provide a soft-start low voltage lighting system that controls the power during turn-on so that lamp and transformer surge current are reduced or eliminated and false breaker trips are eliminated. It is desirable to provide a soft-start low voltage lighting system that warms up the lamp slowly, reducing or eliminating failures due to thermal shock. It is desirable to provide a soft-start low voltage lighting system that eliminates the need for a surge protector, thereby eliminating surge protector losses.

BRIEF SUMMARY OF THE INVENTION

Briefly stated, an embodiment of the present invention comprises a low voltage lighting system that includes a transformer having at least a primary winding and a secondary winding. The low voltage lighting system includes at least one lighting element that is electrically coupled with the secondary winding and a voltage control circuit electrically coupled with the primary winding. The voltage control circuit is configured to automatically increase the voltage applied to the primary winding of the transformer in a predetermined manner from a first voltage to a second voltage over a predetermined period of time.

Another embodiment of the present invention comprises a low voltage lighting system that includes a transformer having at least a primary winding and a secondary winding. The low voltage lighting system includes one or more lighting elements electrically coupled with the secondary winding and a voltage control circuit electrically coupled with the primary winding. The voltage control circuit is configured to automatically increase voltage applied to the primary winding of the transformer in a predetermined manner from a first voltage to a second voltage over a predetermined period of time. The voltage control circuit includes a zero cross detector, a voltage controlled phase timer, a transformer switch, a delay timer and a bypass switch. The zero cross detector detects the zero cross of an alternating current (AC) voltage. The voltage controlled phase timer is electrically coupled to the output of the zero cross detector and automatically increases the voltage applied to the primary winding of the transformer from the first voltage to the second voltage over the predetermined period of time. The transformer switch is electrically coupled with the output of the voltage controlled phase timer and electrically coupled with the primary winding of the transformer. The voltage controlled phase timer controls the ON time of the transformer switch. The transformer switch applies the voltage to the primary winding of the transformer. The delay timer has a second predetermined delay time. The bypass switch is electrically coupled with the delay timer. The bypass switch is configured to bypass at least a portion of the voltage controlled circuit and apply a third voltage to the primary winding of the transformer. The delay timer actuates the bypass switch after the second predetermined delay time.

Another embodiment of the present invention comprises a method of controlling at least one low voltage lighting element. The at least one lighting element is electrically coupled with a secondary winding of a transformer. The transformer has at least a primary winding and the secondary winding. The method includes increasing the voltage applied to the primary winding of the transformer from a first voltage to a second voltage in a predetermined manner over a predetermined period of time using an automatic voltage control circuit.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
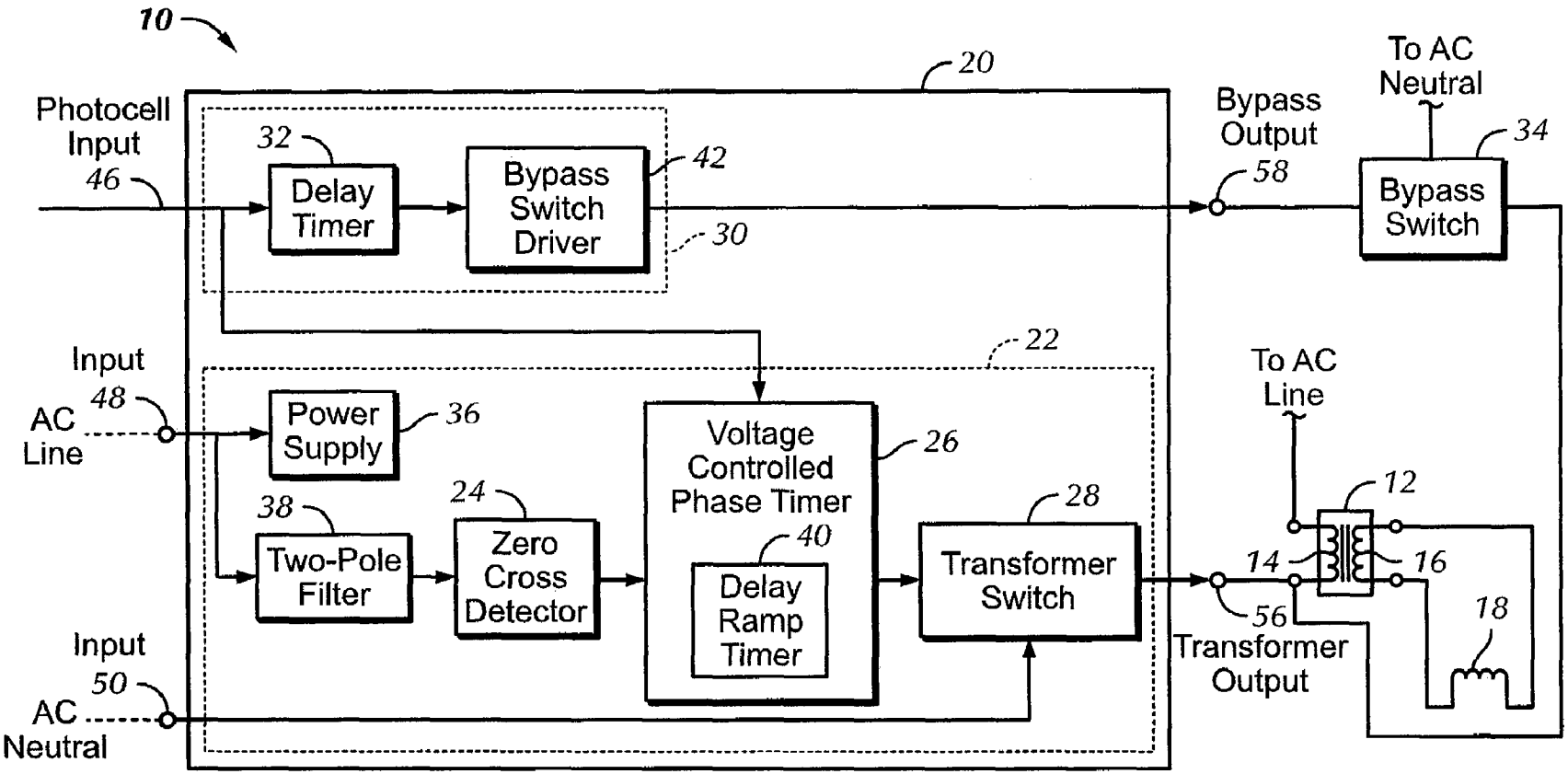
FIG. 1 is a schematic block diagram of a low voltage lighting system in accordance with a preferred embodiment of the present invention.

Certain terminology is used in the following description for convenience only and is not limiting. The words "right," and "left," "lower," and "upper" designate directions in the drawings to which reference is made. The words "inwardly" and "outwardly" refer to directions toward and away from, respectively, the geometric center of the object discussed and designated parts thereof. The terminology includes the words specifically mentioned above, derivatives thereof and words of similar import. Additionally, the words "a" and "an" as used in the claims and in the corresponding portions of the specifications mean at least one.

Referring to the drawings in detail, wherein the same reference numerals indicate like elements throughout, there is shown in FIG. 1 a schematic block diagram of a low voltage lighting system 10 in accordance with a preferred embodiment of the present invention. The low voltage lighting system 10 includes a transformer 12 having at least a primary winding 14 and a secondary winding 16. One or more lighting elements or lamps 18 are electrically coupled with the secondary transformer winding 16. A voltage control circuit 20 is electrically coupled with the primary winding 14 of the transformer 12. The voltage control circuit 20 is configured to automatically increase, in a predetermined manner, the voltage applied to the primary winding 14 of the transformer 12 from a first lower voltage to a second and then a third higher voltage (see e.g. FIG. 4) over a predetermined period of time (t0-t2).

As used herein, a "soft-start" circuit is a type of control circuit that controls a device to apply power or voltage to a load upon energization in a proportionally increasing manner. The proportionally increasing manner may have any type of increasing voltage curve, including a ramp or an exponentially increasing function. But, the term soft-start should not be construed as limiting.

The voltage control circuit 20 includes a soft-start circuit 22 that controls a rate of increase of the voltage applied to the primary winding 14 of the transformer 12 from the first voltage at time t0 to the second voltage at time t2. The soft-start circuit 22 includes a DC power supply 36 that rectifies an alternating current (AC) voltage and supplies DC voltage as needed by the remainder of the voltage control circuit 20. The line input 48 to the power supply 36 is electrically coupled to an AC voltage source (line voltage) which powers the low voltage lighting system 10. The soft-start circuit 22 further includes a two-pole filter 38 that filters out high frequency power line noise and other noise on the AC line voltage.

The soft-start circuit 22 further includes a zero cross detector 24. The zero cross detector 24 is electrically coupled to the output of the two-pole filter 38 for receiving the filtered AC line voltage. The zero cross detector 24 detects each time a zero crossing of the AC line voltage occurs and generates an output signal pulse whenever a zero crossing is detected. With a 60 Hertz (Hz) AC line voltage, a zero crossing will be detected and an output signal will be generated 120 times per second.

The soft-start circuit 22 further includes a voltage controlled phase timer 26 and a transformer switch 28. The voltage controlled phase timer 26 has two inputs. One of the inputs to the voltage controlled phase timer 26 is electrically coupled to a timer 52 and a photocell 54 (see FIG. 3) so that the timer 52 and the photocell 54 provide an ON/OFF signal to the voltage controlled phase timer 26. The other input to the voltage controlled phase timer 26 is electrically coupled to the output of the zero cross detector 24. The transformer switch 28 is electrically coupled to the output of the voltage controlled phase timer 26. The voltage controlled phase timer 26 receives the ON/OFF signal and the output signals from the zero-cross detector 24 and generates output signals for controlling the turning on and off of the transformer switch 28.

The transformer switch 28 has a transformer output 56 which is electrically coupled to one end of the primary winding 14 of the transformer 12. The other end of the primary winding 14 of the transformer 12 is connected to the AC line voltage. The transformer switch 28 also has a neutral input 50 that is electrically coupled to an AC neutral. The transformer switch 28, when turned on, connects the AC Neutral to the one end of the primary winding 14 of the transformer 12, thereby applying the line voltage to the primary winding 14 of the transformer 12 while the transformer switch 28 is turned on.

When the voltage control circuit 20 is in a quiescent state (while the photocell 54 is off and no ON signal is provided to the voltage controlled phase timer 26), the voltage controlled phase timer 26 holds the transformer switch 28 in an off state. Once the photocell 54 is turned on and the ON signal is provided to the voltage controlled phase timer 26, the voltage controlled phase timer 26, using the output signals from the zero cross detector 24, controls the transformer switch 28 to be on for only a predetermined part of each half-cycle of the AC line voltage. Each time the voltage controlled phase timer 26 receives an output signal from the zero cross detector 24, the voltage controlled phase timer 26 turns the transformer switch 28 off for a predetermined time at the beginning of each half-cycle of the AC line voltage (i.e. each time a zero crossing of the AC line voltage is detected). The voltage controlled phase timer 26 then turns the transformer switch 28 on for the remainder of each half-cycle of the AC line voltage. In this manner, the AC line voltage is applied to the primary winding 14 for only a portion of each cycle and, therefore, the net root-mean-square (RMS) voltage which is applied to the primary winding 14 is the first predetermined voltage (see FIG. 4).

The voltage controlled phase timer 26 includes a delay ramp timer 40 that functions to control the point in time during each half-cycle of the AC line voltage that the voltage controlled phase timer 26 turns on the transformer switch 28. After the photocell 54 is turned on, the delay ramp timer 40 determines a first delay time (t0-t1) (see FIG. 4) during which the voltage controlled phase timer 26 turns on the transformer switch 28 for a first portion of each half-cycle of the AC line voltage. After the first delay time (t0-t1) (see FIG. 4), the delay ramp timer 40 times out and controls the voltage controlled phase timer 26 to increase the portion of each half-cycle of the AC line voltage during which the transformer switch 28 is turned on, thereby increasing the RMS voltage which is applied to the primary winding 14 from the first voltage to the second voltage in a predetermined manner, as shown in FIG. 4 from time t1 to t2, thereby increasing the voltage which is applied to the lighting elements or lamps 18 on the secondary winding 16 of the transformer 12.

Figure 3:
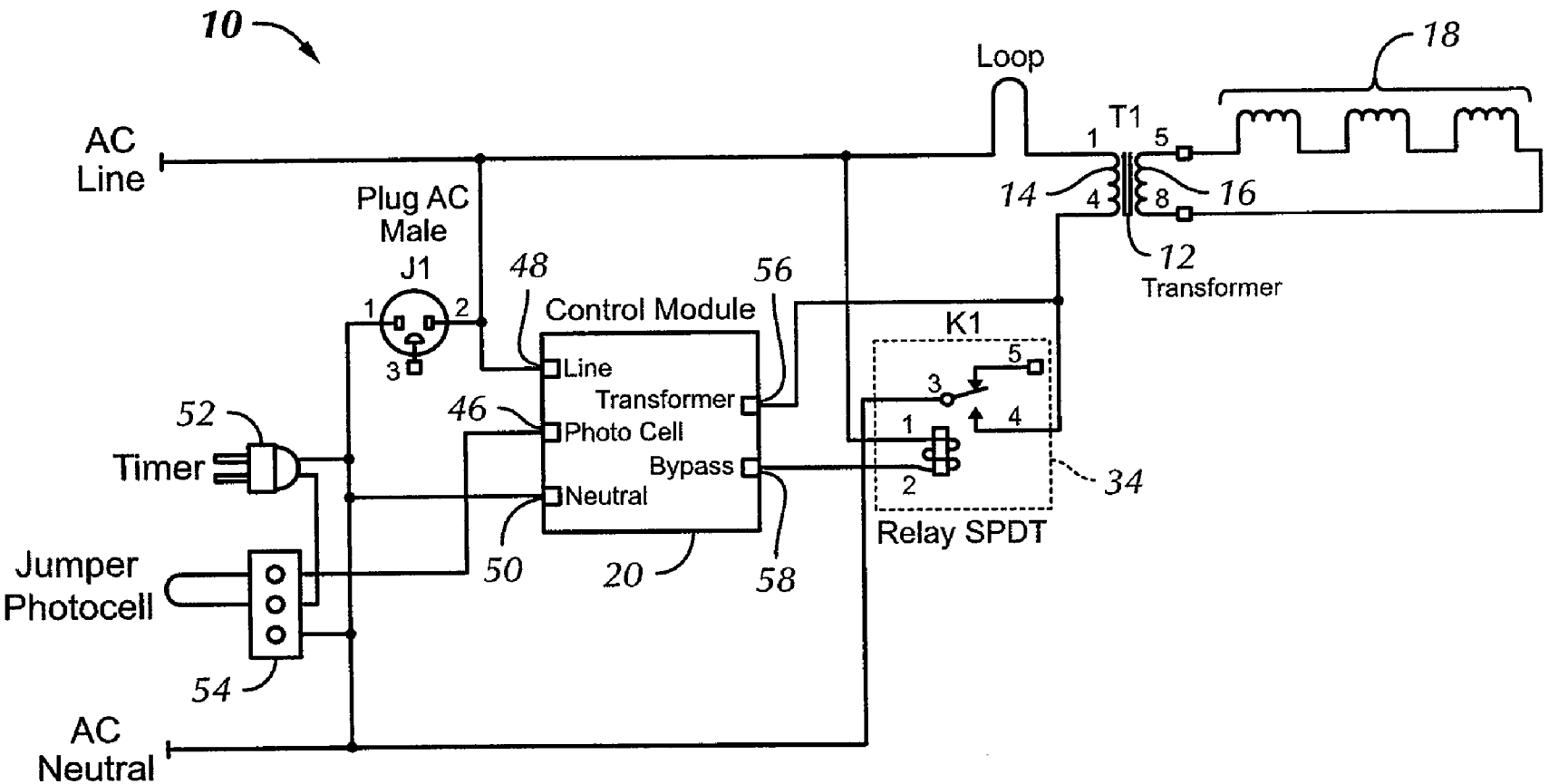
FIG. 3 is a schematic block diagram of a low voltage lighting system using a timer or a photocell.
Figure 4:
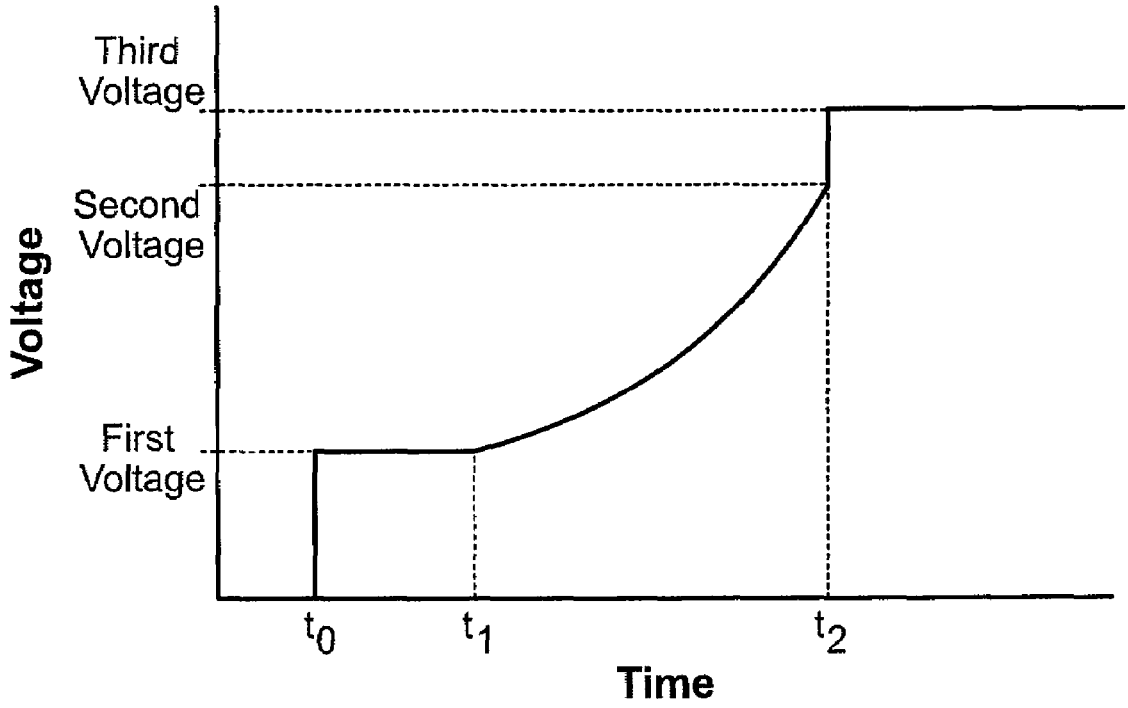
FIG. 4 is a graph of the voltage output over time of the voltage control circuit of the low voltage lighting system of FIGS. 1 and 2.

The voltage control circuit 20 further includes a bypass circuit 30 that bypasses the soft start circuit 22 and applies a third voltage to the primary winding 14 of the transformer 12 (see FIG. 4). The bypass circuit 30 includes a delay timer 32. The delay timer 32 has one input 46 which is electrically coupled the timer 52 and the photocell 54 (see FIG. 3). The delay timer 32 controls a second delay time (t0-t2) (see FIG. 4) before the bypass circuit 30 bypasses the soft start circuit 22. The bypass circuit 30 further includes a bypass switch driver 42 that is electrically coupled to the output of the delay timer 32. After the second delay time has elapsed (at t2), the delay timer 32 turns on the output switch driver 42 which outputs a signal.

The bypass switch driver 42 includes a bypass output 58. The bypass output 58 is electrically coupled to an input of a bypass switch 34. The bypass switch 34 has another input that is that is electrically coupled to the AC neutral. The output of the bypass switch 34 is electrically coupled to one end of the primary winding 14 of the transformer 12. When the delay timer 32 times out at time t2 and turns on the output switch driver 42, the output signal from the output switch driver 42 switches on the bypass switch 34. Once switched on, the bypass switch 34 electrically couples the primary winding 14 of the transformer 12 to the AC Neutral, thereby bypassing the voltage control circuit 20 and allowing the transformer 12 to be powered directly by the third or full line voltage.

One or more of the functional blocks 24, 26, 28, 32, 36, 38, 40, 42, or portions thereof associated with the voltage control circuit 20 may be implemented in an application specific integrated circuit (ASIC), a microcontroller, a programmable logic array (PLA) or the like. Likewise, specific circuit functions may be implemented in hardware, digital circuitry or dedicated integrated circuits (IC's) such as timer IC's or the like.

Referring to FIG. 4, when the photocell 54 (see FIG. 3) is activated, the voltage control circuit 20 applies the first voltage, for example 23V RMS, to the primary winding 14 for a time period (t0-t1) greater than zero established by the delay ramp timer 40 in order allow the lighting elements 18 to slowly warm up to a light glow before increasing the voltage applied to the primary winding 14 in a predetermined manner as shown by the curve between t1 and t2 (see FIG. 4) to the second voltage, for example 110V RMS. At time t2, the delay timer 32 times out and the bypass switch 34 is actuated to bypass the voltage control circuit 20 and a third voltage that is the full line voltage is applied to the transformer 12.

Figure 2:
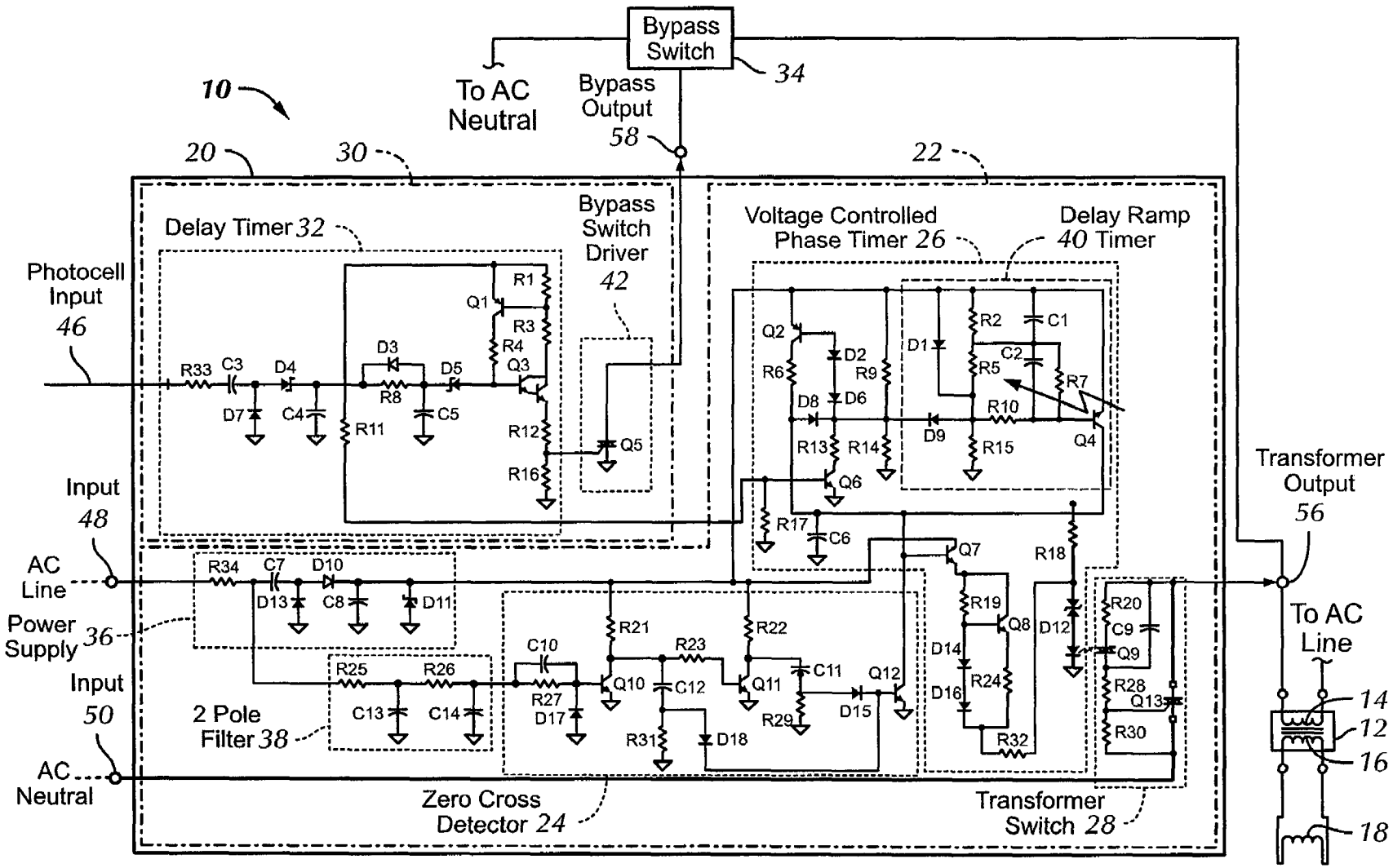
FIG. 2 is an electrical schematic diagram of one detailed implementation of a low voltage lighting system in accordance with a preferred embodiment of the present invention.

FIG. 2 shows one possible detailed circuit implementation of a low voltage lighting system 10 in accordance with a preferred embodiment of the present invention. The low voltage lighting system 10 includes a transformer 12 having at least a primary winding 14 and a secondary winding 16. One or more lighting elements or lamps 18 are electrically coupled with the secondary transformer winding 16. A voltage control circuit 20 is electrically coupled with the primary winding 14 of the transformer 12. The voltage control circuit 20 is configured to automatically increase, in a predetermined manner, the voltage applied to the primary winding 14 of the transformer 12 from a first lower voltage to a second and then a third higher voltage (see e.g. FIG. 4) over a predetermined period of time (t0-t2).

The voltage control circuit 20 includes a soft-start circuit 22 that controls a rate of increase of the voltage applied to the primary winding 14 of the transformer 12 from the first voltage at time t0 to the second voltage at time t2. The soft-start circuit 22 includes a DC power supply 36 that rectifies an alternating current (AC) voltage and supplies DC voltage as needed by the remainder of the voltage control circuit 20. The line input 48 to the power supply 36 is electrically coupled to an AC voltage source (line voltage) which powers the low voltage lighting system 10. The power supply 36 includes capacitors C7 and C8; resistor R34; and diodes D10, D11 and D13. The power supply 36 receives an AC voltage as input and rectifies the AC voltage in order to power the rest of the circuit 20. When about 120 volts (V) AC is applied to the input 48 to the power supply 36, a voltage of about 40V DC is created on capacitor C8 to power the rest of voltage control circuit 20.

The soft-start circuit 22 further includes a two-pole filter 38 and a zero cross detector 24. The two-pole filter 38 is electrically coupled to the AC line voltage. The zero cross detector 24 is electrically coupled to the output of the two-pole filter 38. The two-pole filter 38 filters out high frequency power line noise and other noise on the AC line voltage to provide a clean signal for the zero cross detector 24. The two-pole filter 38 includes resistors R25 and R26 and capacitors C13 and C14, which give the two-pole filter 38 a breakpoint frequency of about 270 Hz. The break point of about 270 Hz was generally found to achieve the best filtering and minimum phase delay during experimentation and design testing. Capacitor C10 and resistor R27 provide a lead network to compensate for the delay in the zero cross detector 24.

The zero cross detector 24 detects each time a zero crossing of the AC line voltage occurs and generates an output signal pulse whenever a zero crossing is detected. With a 60 Hertz (Hz) AC line voltage, a zero crossing will be detected and an output signal will be generated 120 times per second. The zero-cross detector 24 includes transistors Q10, Q11 and Q12; capacitors C10, C11 and C12; resistors R27, R21, R31, R23, R22 and R29; and diodes D17, D18 and D15. Transistor Q10 creates a 60 Hz square wave and transistor Q11 inverts the square wave. Capacitor-resistor pairs C12-R31 and C11-R29 are differentiators that generate narrow pulses conducted through diodes D15 and D18. The narrow pulses turn on transistor Q12 precisely at both the positive going and the negative zero crossing of the power line voltage. Transistor Q12 then discharges a timing capacitor C6 to zero volts at each zero crossing to create the output signals.

The soft-start circuit 22 further includes a voltage controlled phase timer 26 and a transformer switch 28. The voltage controlled phase timer 26 has two inputs, one is electrically coupled to a timer 52 and a photocell 54 (see FIG. 3) so that the timer 52 and the photocell 54 provide an on/off signal to the voltage controlled phase timer 26. The other input to the voltage controlled phase timer 26 is electrically coupled to the output of the zero cross detector 24. The transformer switch 28 is electrically coupled to the output of the voltage controlled phase timer 26. The voltage controlled phase timer 26 receives the output signals from the zero-cross detector 24 and generates output signals for controlling the turning on and off of the transformer switch 28.

The voltage controlled phase timer 26 includes the timing capacitor C6, which controls the voltage applied to the transformer switch 28. The voltage controlled phase timer 26 also includes transistors Q2, Q4, Q6, Q7 and Q8 and biasing circuitry such as diodes D1, D2, D6, D8, D9, D14 and D16; resistors R2, R5, R6, R7, R10, R15, R9, R14, R13, R17, R19, R24, R18 and R32; capacitors C1 and C2; diac D12; and a photodiode of triac optocoupler Q9.

When the voltage control circuit 20 is in a quiescent state (while the photocell 54 is off), the voltage across capacitor C4 is zero, so transistors Q6 and Q2 are "off" and no current is supplied to the timing capacitor C6. With no current being supplied, there is no voltage across the timing capacitor C6, and the transformer switch 28 remains in an off state.

Once the photocell 54 is turned on, 120V AC is applied to the photocell input 46, the 120V AC is rectified by zener diode D4 and diode D7 and filtered by capacitor C4. Zener diode D4 clamps the voltage on capacitor C4 to about 10V DC. The voltage across capacitor C4 biases transistor Q6 "on" through resistor R11, which then biases "on" transistor Q2.

The voltage controlled phase timer 26 controls the transformer switch 28 to be on for only a predetermined part of each half-cycle of the AC line voltage. Each time the zero cross detector 24 detects a zero crossing of the AC line voltage, the timing capacitor C6 is discharged to zero volts, turning the transformer switch 28 off. The transformer switch 28 remains off for a predetermined time at the beginning of each cycle of the AC line voltage.

After each discharge at the zero crossing of the AC line voltage, the timing capacitor C6 is charged up by two separate current sources, both of which are turned on by transistor Q6 when the photocell input 46 is energized. The first is a fixed current sourced to the timing capacitor C6 by transistor Q2 and resistor R6. The second is an increasing current that is sourced by delay ramp timer 40 via transistor Q4. The current sourced by transistor Q4 is initially held at zero for a first predetermined delay time. After the first predetermined delay time, the current sourced by transistor Q4 begins to increase exponentially, thus creating two phases of the power-up cycle as shown in FIG. 4. These functions have been found to provide an approximately linear increasing lamp intensity.

During the first phase of the power-up cycle (time t0-t1) (see FIG. 4), the timing capacitor C6 is charged up only by transistor Q2, which is turned on as soon as transistor Q6 starts to conduct. With transistor Q2 becomes saturated, resistor R6 conducts a fixed current, charging the timing capacitor C6 slowly up toward about 40V. Transistor Q6 also biases diodes D2, D6 and D9 and transistor Q2. This provides a voltage of about −2.1V that charges capacitor C2 through diode D9 and resistor R10. Diode D9 balances the discharge time of capacitor C2 when the photocell input 46 turns off. Diode D1 and resistors R2 and R5 provide a temperature compensated bias with a short time constant to ensure no long delay when the voltage control circuit 20 is powered up. The first phase of the power-up cycle lasts for a predetermined first delay time (t0-t1) (see FIG. 4).

The voltage controlled phase timer 26 includes a delay ramp timer 40 that functions to control the second phase of the power up cycle (time t1-t2) (see FIG. 4). The delay ramp timer 40 determines the length of the first delay time. After the first delay time (t0-t1) (see FIG. 4), the delay ramp timer 40 controls the voltage controlled phase timer 26 to increase the portion of the cycle of the AC line voltage during which the transformer switch 28 is turned on, thereby increasing the RMS voltage which is applied to the primary winding 14 in a predetermined manner, as shown in FIG. 4 from time t1 to t2, thereby correspondingly by increasing the voltage which is applied to the lighting elements or lamps 18 on the secondary winding 16 of the transformer 12.

The delay ramp timer 40 controls resistor R13 and diode D8 to help maintain the charge current of the timing capacitor C6 as transistor Q4 approaches saturation. Capacitor C1 is biased with about 400 millivolts (mv). When capacitor C2 charges up to about 200 mv, the sum of the voltages on capacitors C1 and C2 forward biases an emitter-base junction of transistor Q4 and transistor Q4 starts to conduct. The threshold signifies the beginning of the second phase of the power-up sequence.

During the second phase of the power-up cycle, a linear increasing base voltage on transistor Q4 causes an exponentially increasing collector current. The exponentially increasing current charges the timing capacitor C6 faster and faster. Within about two to three seconds, the charge rate on capacitor C6 is so high that capacitor C6 charges from zero volts up to about 30V in under 1 millisecond (ms).

Once the voltage across the timing capacitor reaches about 30V, the voltage controlled phase timer 26 turns the transformer switch 28 on for the remainder of each half-cycle of the AC line voltage. The voltage across the timing capacitor C6 is applied across diac D12 through transistors Q7 and Q8, resistors R24 and R32 and triac optocoupler Q9. When the voltage on diac D12 reaches about 30V, diac D12 switches on and conducts, turning on triac optocoupler Q9. Transistor Q7 buffers the voltage on the timing capacitor C6; and transistor Q8 limits the current after the diac D12 conducts. The current provided by transistor Q7 keeps the diac D12 conducting without discharging the timing capacitor C6.

The transformer switch 28 includes the triac optocoupler Q9; resistors R20, R28 and R30; capacitor C9; and triac Q13. Output triac Q13 is electrically coupled to the neutral AC line input 50 and to transformer output 56. The transformer switch 28 provides controlled effective voltage to the primary winding 14 of the transformer 12 that is less than the maximum power line voltage. When diac D12 turns on triac optocoupler Q9, triac optocoupler Q9 turns on output triac Q13. The optocoupler Q9 optically isolates the rest of the voltage control circuit 20 from the switched voltage applied to the transformer 112 via output triac Q13. Diac D12 holds triac optocoupler Q9 and triac Q13 on until a zero crossing occurs. This is done because the current drawn by the transformer 12 with no load or with a light load drops below the threshold needed to keep triac Q13 turned on. If triac Q13 turns off prematurely, the transformer 12 saturates on the next cycle and the current then goes very high.

The timing of the voltage controlled phase timer 26 is set so that, during the first phase of the power-up cycle, triac Q13 turns on about 2 ms before the power line voltage crosses zero. The RMS output power is greatly reduced (chopped) because the voltage to the transformer 12 is only on for about the last 2 ms out of about 8.3 ms of each power line half-cycle. The chopped output power is held fixed for about 2 to 3 seconds. During the second phase of the power-up cycle, the voltage to the transformer 12 is switched on near the beginning of the cycle and close to full RMS power is applied to transformer 12 and the lighting elements or lamps 18. The low voltage lighting system 10 warms the lighting elements or lamps 18 quicker while doing so with less stress. The intensity of the lighting elements or lamps 18 appears to increase steadily.

The voltage control circuit 20 further includes a bypass circuit 30 that bypasses the soft start circuit 22 and applies a third voltage to the primary winding 14 of the transformer 12 (see FIG. 4). The bypass circuit 30 includes a delay timer 32 and a bypass switch driver 42. The bypass switch driver 42 is electrically coupled to the output of the delay timer 32. The delay timer 32 has one input 46 which is electrically coupled the timer 52 and the photocell 54 (see FIG. 3). The delay timer 32 controls a second delay time (t0-t2) (see FIG. 4) before the bypass circuit 30 bypasses the soft start circuit 22.

The delay timer 32 includes a timing circuit comprised of resistor R8 and capacitor C5 to control the delay before the bypass switch bypasses the voltage control circuit 20. The delay timer also includes transistors Q1 and Q3 to drive a bypass switch driver 42, which is comprised of triac Q5. As described above, after 120V AC is applied to the photocell input 46, zener diode D4 clamps the voltage on capacitor C4 to about 10V DC. The second delay time of about 6 to 8 seconds (t0-t2) (see FIG. 4) is created as the voltage on capacitor C4 starts charging capacitor C5 through resistor R8. When the voltage on capacitor C5 exceeds about 5.6 volts, zener diode D5 conducts turning on transistors Q1 and Q3. After the second delay time, transistors Q1 and Q3 energize triac Q5. The bypass switch driver 42 also includes a bypass output 58, which is comprised of the collector of triac Q5.

The bypass output 58 is electrically coupled to the input of a bypass switch 34. The bypass switch driver 42 and the bypass switch 34 may each be a switching device such as a silicon controlled rectifier (SCR), a transistor, any solid-state switching device, a relay or the like. The bypass switch 34 has one output that is that is electrically coupled to the AC neutral. The other output of the bypass switch 34 is electrically coupled to one end of the primary winding 14 of the transformer 12. When the delay timer 32 turns on the bypass switch driver 42, the bypass switch driver 42 switches on the bypass switch 34. Preferably, the bypass switch driver 42 is a triac (Q5) and the bypass switch 34 is a relay. Once switched on, the bypass switch 34 electrically couples the primary winding 14 of the transformer 12 to the AC Neutral, thereby bypassing the voltage control circuit 20 and thereby eliminating the losses of the voltage control circuit 20, thereby allowing the transformer 12 to be powered by the full line voltage. The turn-on delay for the bypass switch 34 is created by the long time constant of resistor R8 and capacitor C5. Transistor Q1 provides positive feedback, speeding the turn on of triac Q5.

FIG. 3 shows a system incorporating a low voltage lighting system 10 in accordance with a preferred embodiment of the present invention. Voltage control circuit 20 has one input 46, two outputs 56 and 58 and power connections 48 and 50. The low voltage lighting system 10 is powered by an 120V AC voltage source. The input 46 is electrically coupled to a photocell 54 and a timer 52. The outputs control the transformer 12 and the bypass switch 34. Both the transformer output 56 and the bypass output 58, when active, are connected to the AC neutral 50 via bypass switch driver 34. The bypass output 58 is an on/off output and the transformer output 56 is phase controlled. The bypass switch 34 is connected in parallel with transformer output 56 and eliminates the losses of the voltage control circuit 20 during normal operation. Additionally, when the photocell 54 or the timer 52 shuts off, the bypass switch 34 is de-energized and the transformer switch 28 decreases the transformer voltage, fading the lighting elements or lamps 18 down slowly to the off state, eliminating fast cool down.

FIG. 4 shows a chart of the RMS voltage applied to the primary winding 14 of the transformer 12 of a low voltage lighting system 10 in accordance with FIGS. 1-2. When the low voltage lighting system 10 is turned on at time t0, a first voltage is applied to the primary winding 14 of the transformer 12. The first voltage applied to the primary winding 14 of the transformer 12 is fixed and held low until time t1, for example 2 seconds, as the lighting elements or lamps 18 slowly warm to a light glow. At time t1, the voltage applied to the primary winding 14 of the transformer 12 is increased in a predetermined manner from the first voltage to the second voltage. By the time the second voltage is reached at time t2, the lighting elements or lamps 18 are near full brightness. At time t2, for example 6-8 seconds, the bypass switch 34 is used to bypass the voltage control circuit 20 and a third voltage that is the fall line voltage is applied to the transformer 12.

Embodiments of the present invention also include a method of controlling lighting elements 18 using a low voltage lighting system 10 in accordance with FIGS. 1-2. The lighting elements 18 are electrically coupled with the secondary winding 16 of the transformer 12. The transformer 12 has at least the primary winding 14 and the secondary winding 16. The method includes increasing the voltage applied to the primary winding 14 of the transformer 12 from the first voltage to the second voltage over a predetermined period of time using the automatic voltage control circuit 20. The method further includes, after a second delay time, applying a third voltage to the primary winding 14 of the transformer 12 by bypassing the automatic voltage control circuit 20. The first voltage may be applied to the primary winding 14 of the transformer 12 for a first predetermined delay time.

From the foregoing, it can be seen that embodiments of the present invention comprise a low voltage lighting system having a soft-start. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A low voltage lighting system comprising:

(a) a transformer having at least a primary winding and a secondary winding;

(b) a lighting element electrically coupled with the secondary winding; and (c) a voltage control circuit electrically coupled with the primary winding, the voltage control circuit being configured to automatically increase the voltage applied to the primary winding of the transformer in a predetermined manner from a first voltage to a second voltage over a predetermined period of time, the voltage control circuit including:

(i) a soft-start circuit that controls a rate of increase of voltage applied to the primary winding of the transformer from the first voltage to the second voltage, and (ii) a bypass circuit that bypasses the soft start circuit and applies a third voltage to the primary winding.

2. The low voltage lighting system of claim 1, wherein the first voltage is one of equal to zero and greater than zero.

3. The low voltage lighting system of claim 1, wherein the voltage control circuit controls the length of time that the first voltage is applied to the primary winding.

4. A low voltage lighting system comprising:

(a) a transformer having at least a primary winding and a secondary winding;

(b) a lighting element electrically coupled with the secondary winding; and (c) a voltage control circuit electrically coupled with the primary winding, the voltage control circuit being configured to automatically increase the voltage applied to the primary winding of the transformer in a predetermined manner from a first voltage to a second voltage over a predetermined period of time, the voltage control circuit including a soft-start circuit that controls a rate of increase of voltage applied to the primary winding of the transformer from the first voltage to the second voltage, the soft-start circuit including:

(i) a zero cross detector that detects the zero crossing of an alternating current (AC) voltage;

(ii) a voltage controlled phase timer electrically coupled to the output of the zero cross detector that detects the zero crossing of an AC voltage and generates output signals; and (iii) a transformer switch electrically coupled with the output of the voltage controlled phase timer, the voltage controlled phase timer controlling the ON time of the transformer switch, the transformer switch applying a voltage to the primary winding of the transformer.

5. A low voltage lighting system comprising:

(a) a transformer having at least a primary winding and a secondary winding;

(b) a lighting element electrically coupled with the secondary winding; and (c) a voltage control circuit electrically coupled with the primary winding, the voltage control circuit being configured to automatically increase the voltage applied to the primary winding of the transformer in a predetermined manner from a first voltage to a second voltage over a predetermined period of time, the voltage control circuit including a soft-start circuit that controls a rate of increase of voltage applied to the primary winding of the transformer from the first voltage to the second voltage, the voltage control circuit also including a bypass circuit that bypasses the soft start circuit and applies a third voltage to the primary winding, the bypass circuit including:

(i) a delay timer that has a second predetermined delay time; and (ii) a bypass switch that is electrically coupled to the output of the delay timer, the bypass switch being configured to bypass the voltage control circuit and apply the third voltage to the primary winding, the delay timer actuating the bypass switch after the second predetermined delay time.

6. A low voltage lighting system comprising:

(a) a transformer having at least a primary winding and a secondary winding;

(b) a lighting element electrically coupled with the second winding; and (c) a voltage control circuit electrically coupled with the primary winding, the voltage control circuit being configured to automatically increase the voltage applied to the primary winding of the transformer in a predetermined manner from a first voltage to a second voltage over a predetermined period of time, the voltage control circuit comprising:

(i) a zero cross detector that detects the zero crossing of an alternating current (AC) voltage;

(ii) a voltage controlled phase timer electrically coupled to the output of the zero cross detector, the voltage controlled circuit automatically increasing the voltage applied to the primary winding of the transformer from a first voltage to a second voltage over the predetermined period of time;

(iii) a transformer switch electrically coupled with the output of the voltage controlled phase timer and electrically coupled with the primary winding of the transformer, the voltage controlled phase timer controlling the ON time of the transformer switch to apply a voltage to the primary winding of the transformer;

(iv) a delay timer having a second predetermined delay time; and (v) a bypass switch electrically coupled with the delay timer, the bypass switch being configured to bypass at least a portion of the voltage controlled circuit and apply a third voltage to the primary winding of the transformer, the delay timer actuating the bypass switch after the second predetermined delay time.

7. The low voltage lighting system of claim 6, wherein the voltage controlled phase timer includes a delay ramp timer establishing a first predetermined delay time that the first voltage is applied to the primary winding.

8. The low voltage lighting system of claim 6, further comprising:

(vi) a bypass switch driver electrically coupled to the delay timer and electrically coupled to the bypass switch, the delay timer controlling the bypass switch driver, the bypass switch driver controlling the bypass switch.

9. A method of controlling at least one low voltage lighting element, the lighting element being electrically coupled with a secondary winding of a transformer, the transformer having at least a primary winding and the secondary winding, the method comprising:

after a first delay time, increasing the voltage applied to the primary winding of the transformer from a first voltage to a second voltage in a predetermined manner over a predetermined period of time using an automatic voltage control circuit;

controlling a rate of increase of voltage applied to the primary winding of the transformer from the first voltage to the second voltage using a soft-start circuit; and after a second delay time, applying a third voltage to the primary winding of the transformer.

10. The method of claim 9, wherein the third voltage is applied to the primary winding of the transformer by bypassing the automatic voltage control circuit.

11. The method of claim 9, further comprising:

applying the first voltage to the primary winding of the transformer for a first predetermined delay time.

* * * * *